United States Patent [19]

Sauvinet et al.

[11] Patent Number: 5,005,769

[45] Date of Patent: Apr. 9, 1991

[54] DISTRIBUTION OF A PULVERULENT SOLID

[75] Inventors: Vincent Sauvinet, Paris; Jean Fosset, Saint-Leger Aux Bois; Michel Valere, Thourotte; Daniel Defort, Lacroix Saint-Quen; Maurice Boutrouille, Melicocq, all of France

[73] Assignee: Saint Gobain-Vitrage International, Courbevoie, France

[21] Appl. No.: 450,793

[22] Filed: Dec. 14, 1989

[30] Foreign Application Priority Data

Dec. 14, 1988 [FR] France ..... 88 16436

[51] Int. Cl.[5] ..... B05C 19/00; B05B 7/14

[52] U.S. Cl. ..... 239/429; 239/597; 118/308

[58] Field of Search ..... 427/180, 421; 118/308, 118/310, 311; 239/434, 434.5, 597, 597.5, 427.3, 654, 429, 430

[56] References Cited

U.S. PATENT DOCUMENTS

| | | | |
|---|---|---|---|
| 745,518 | 12/1903 | Pettengill | 239/597 X |
| 1,462,680 | 7/1923 | Bliss | 239/427.3 |
| 4,230,271 | 10/1980 | Marcault | 239/113 |
| 4,325,988 | 4/1982 | Wagner | 427/160 |
| 4,344,986 | 8/1982 | Henery | 427/180 |
| 4,401,695 | 8/1983 | Sopko | 427/180 |
| 4,533,571 | 8/1985 | Kramer et al. | 427/180 |
| 4,562,095 | 12/1985 | Coulon et al. | 427/180 |
| 4,837,093 | 6/1989 | Coulon et al. | 428/432 |
| 4,903,895 | 2/1990 | Mathewson et al. | 239/430 X |

FOREIGN PATENT DOCUMENTS 2288068 6/1976 France .

*Primary Examiner*—Andres Kashnikow
*Assistant Examiner*—Kevin Weldon
*Attorney, Agent, or Firm*—Pennie & Edmonds

[57] ABSTRACT

The invention relates to a device for the distribution of pulverulent product on a substrate. The device has two walls delimiting a blade-shaped cavity converging toward substrate, a gas injection chamber closed by a plate, pierced with a multiplicity of jets 12 for injecting a gas under pressure inducing ambient air into the cavity substantially parallel to the wall of the cavity which is adjacent thereto which homogenizes the pulverulent gas product mixture and accelerates it in the direction of the substrate, thus forming a uniform thin layer on a substrate.

46 Claims, 3 Drawing Sheets

DISTRIBUTION OF A PULVERULENT SOLID

FIELD OF INVENTION

The invention relates to a device for the homogeneous distribution of a pulverulent product on a substrate, in particular, a glass substrate. The device homogenizes a mixture of a pulverulent product in a gas and deposits the mixture on the substrate. Decomposition of the mixture provides a uniform thin layer on the substrate, which layer exhibits particular optical and/or electrical properties.

BACKGROUND OF INVENTION

A device for the distrubution of pulverulent products suspended in a gas on a substrate, such as a ribbon of glass is known by U.S. Pat. No. 4,230,271. The pulverulent products suspended in gas are distributed through a distribution slot placed above the glass. The distribution slot is the lower end of a nozzle which comprises a cavity extending over the entire length of the nozzle and exhibits a venturi shaped cross section. The cavity is fed with a pulverulent product suspended in a gas by a plurality of elementary ducts of the same length resulting from the subdivision of a single pulverulent product feeding duct. Also, the nozzle comprises a broad approximately parallelepiped homogenization chamber that exhibits a venturi-shaped cavity and extends over the entire length of the nozzle. The homogenization chamber also receives gas under pressure to create the turbulences required to homogenize the mixture of the pulverulent product and gas. The homogenization chamber comprises a narrow passage extending over the entire length of the nozzle that exhibits an expanding section and then a converging section which terminates at the distribution slot.

Although the nozzle provides desirable results, it is sensitive to clogging and periodically requires cleaning to continue operating correctly. This periodic cleaning results in a loss of production. In addition, while such nozzles have been made with distribution slot lengths of 250 to 650 mm, to coat glass ribbons several meters wide there must be several identical nozzles positioned end to end. In such circumstances, it is extremely difficult to balance the various nozzles to assure a regular and uniform distribution of pulverulent product over the entire width of the glass. It would be preferable to use a single nozzle of greater length, for example a length at least equal to that of the ribbon of float glass which generally reaches more than 3 m, but it has been found that the uniformity of the resultant layer is reduced. This results in unacceptable variations in color of the deposited layer.

To eliminate these drawbacks, U.S. Pat. No. 4,562,095 proposed a process and a device for distribution of a pulverulent product on a substrate, whose length corresponds to the width of the substrate, while also providing a uniform distribution of the pulverulent product in time and space. The object of that patent was directed to the forming of a stream of a pulverulent product suspended in a gas in the shape of a blade, directly above the substrate and over a length at least equal to the width of the substrate to be coated. In addition, to maintain the stream of the pulverulent product in a continuous flow in the direction of the substrate over its entire length, gas currents are introduced into this stream to create turbulence in an attempt to homogenize the mixture of gas and the pulverulent product as the mixture is directed toward the substrate. Finally, to uniformly accelerate the movement of the pulverulent product gas mixture toward the substrate, this mixture is entrained in additional gas currents introduced from the sidewalls of the device toward the direction of the substrate. According to that patent, the homogenization and acceleration can take place in one and the same step.

U.S. Pat. No. 4,562,095 specifically describes a nozzle as a device for the distribution of the pulverulent product whose length can correspond to the width of the substrate to be coated. This nozzle comprises a longitudinal cavity whose walls converge uniformly in the direction of the substrate to be coated, so that the zones of homogenization and acceleration converge. The upper part of the nozzle comprises an element for covering the cavity which is pierced with an orifice which makes possible the feeding, through separate ducts, of the pulverulent product suspended in a gas which is called a primary gas. The ducts for feeding the pulverulent product primary gas mixture are not constructed in an airtight manner in the orifice, and this allows the introduction of air from the ambient atmosphere to be introduced into the inside cavity of the nozzle.

In the upper part of the nozzle, the longitudinal walls of the cavity and the covering element delimit two continuous slots which extend over the entire length of the nozzle through which additional gases under pressure are introduced. These gases are called secondary gases. The secondary gas is injected at a speed much greater than that of the primary gas in which the pulverulent product is suspended. The increased speed makes it possible to accelerate the displacement of the pulverulent product toward the distribution slot of the nozzle and facilitates the uniform distribution of the injected gas flow over the entire length of the nozzle. The secondary gas also entrains gas or air from the ambient atmosphere (induced gas or air), thus making possible the formation of turbulence which facilitates the homogenization of the pulverulent product gas mixture.

This device exhibits certain advantages, in particular, the injected secondary gas and the induced air enter at the same level as the end of the pulverulent product feeding ducts. This makes it possible to eliminate the dangers of depositing pulverulent product on the walls of the cavity of the nozzle or of driving the pulverulent product back through the orifice of the upper part of the nozzle.

The aim is, however, to improve still further the homogenization of the powder-gas mixture and to make the distribution of this mixture still more uniform throughout the whole length of the nozzle.

SUMMARY OF THE INVENTION

According to the invention, the device for the distribution of pulverulent product suspended in a gas on an advancing substrate comprises two walls which delimit a blade-shaped cavity arranged perpendicular to the direction of displacement of the substrate, these walls forming at their lower part an outlet slot and at their upper part an orifice, injectors of pulverulent product suspended in a gas, forming a line of injectors placed in the orifice of the upper part of the cavity and placed approximately in the plane of the blade, a gas intake in the cavity adjacent to the injectors and at least one means for injecting gas under pressure in the cavity.

This device is characterized in that the injection means (9) comprises a chamber (10), supplied with pressurized gas, which leads into the cavity (5) through an opening (12) disposed in such a way as to inject the gas into the cavity substantially parallel to the wall of the cavity which is adjacent thereto, towards the substrate.

According to one embodiment of the invention, the opening (12) is constituted of a plurality of adjutages having their axes substantially parallel to the wall of the cavity which is adjacent to them, these adjutages being distributed transversely to the substrate.

These adjutages are formed in a plate (11) which closes the chamber and which extends transversely to the substrate. If necessary, this plate is formed of several elements adjacent to one another.

The injection means (9) for pressurized gas is advantageously disposed on one side only of the line of the injectors.

BRIEF DESCRIPTION OF THE DRAWINGS

Further details and advantages of the invention are described in detail below based on the drawings, wherein.

DETAILED DESCRIPTION OF THE PREFERRED EMBODIMENTS

Figure 1:
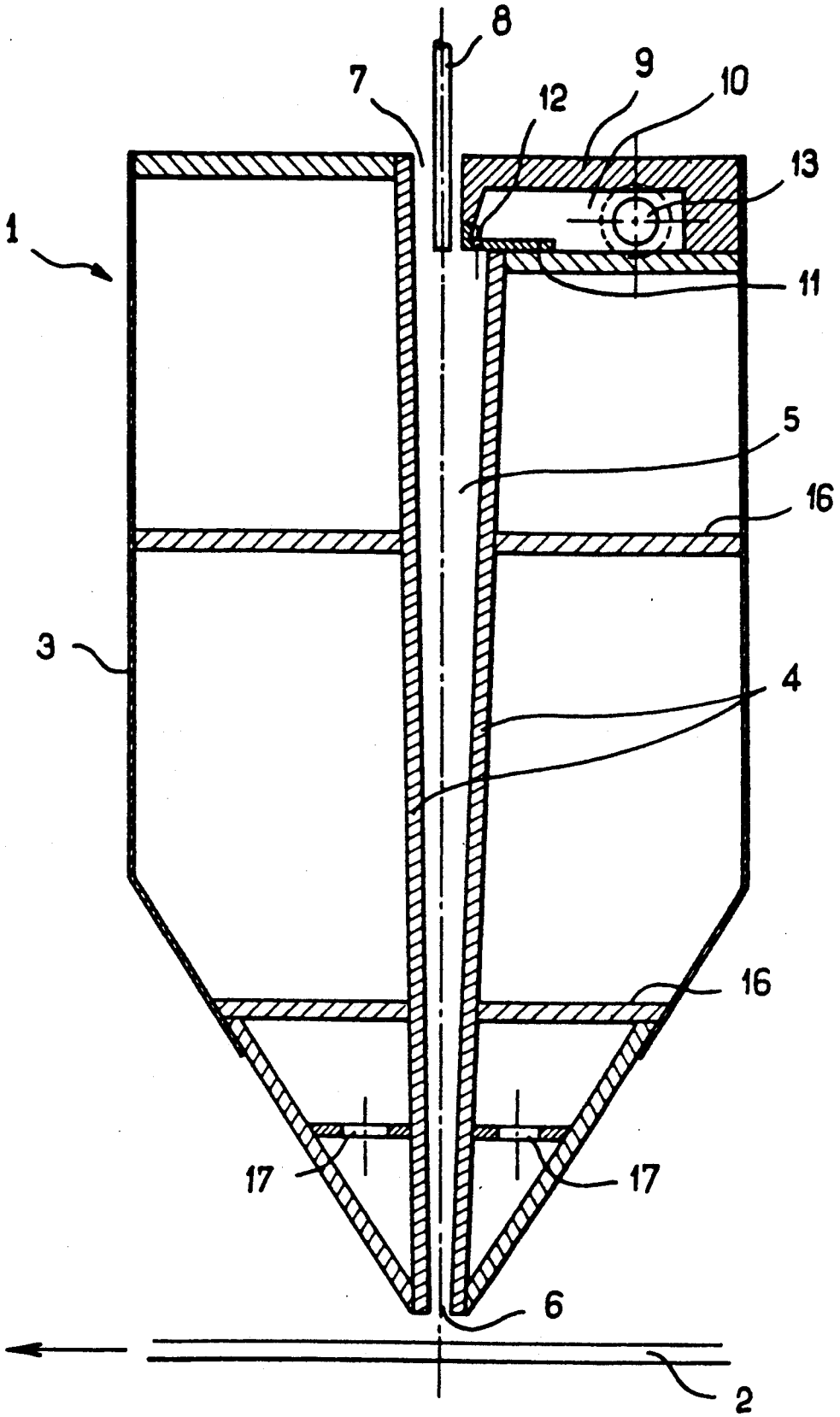
FIG. 1 discloses a device for distribution of pulverulent product according to the invention in the form of a sectional drawing.

The nozzle (1) represented in cross section in FIG. 1, is adapted to deposit on an advancing substrate, preferably over the entire width of the substrate, a pulverulent product hereafter called powder, suspended in a gas. The nozzle (1) has a length which depends on the width of the substrate (2) to be coated. The nozzle (1) can have a length from about fifty centimeters to several meters.

The nozzle (1) can be used to coat various substrates such as glass, metal, wood, paper, which advance under the nozzle at a constant speed. In particular, when the substrate (2) is a ribbon of glass, the substrate (2) can have an advancing speed between 6 and 25 m/min as required by its production.

In the embodiment of FIG. 1, nozzle (1) is made with a body (3) comprising two inner walls (4) which delimit a narrow blade-shaped cavity (5) arranged perpendicular to the direction of displacement of substrate (2). The inner walls (4) are planar and form an angle of 0° to 3° between the median plane of the cavity. Advantageously, the inner walls (4) delimit a blade-shaped cavity (5) which is uniformly convergent toward the surface of the substrate (2). The inner walls (4) form an outlet slot (6) in the lower part of the nozzle (1) for distributing the powder on the substrate (2). The outlet slot (6) advantageously has a width of about 3 to 4 times less than the width between the inner walls (4) in the upper part, i.e., at the intake of the nozzle. For example, the distance between walls (4) at the intake of the nozzle (1) can be between about 6 mm and 40 mm, at the level of the outlet slot (6) it is at most 10 mm and preferably between 3 mm and 5 mm. The upper part of the nozzle (1) comprises an orifice (7) located in the extension of cavity (5). Vertical plates, not shown, laterally limit the air space and orifice (7).

Nozzle (1) is associated with at least one injector (8) of powder suspended in gas known as primary gas, such as air or nitrogen. In general, several injectors are placed in orifice (7) to form a line of injectors over the entire length of the nozzle (1), so as to inject a multiplicity of jets of powder suspended in gas into the cavity (5) delimited by the inner walls (4). The position of the injectors (8) is adjustable vertically, crosswise and laterally in orifice (7). The injectors can be oriented perpendicularly to the axis of the outlet slot (6). These injectors (8) can also be positioned in a direction not perpendicular to the axis of outlet slot (6).

The end of the injectors (8) of the powder can be at various levels depending on the desired injection conditions of the powder suspended in gas into the cavity (5), which depend on the desired characteristics of the layer of powder distributed on the substrate (2). Preferably, the end of the injectors (8) are located at the level of the opening (12) of gas under pressure, described below. The injectors (8) have a cross-sectional width less than that of orifice (7) to make possible an intake of ambient air into the cavity (5) via space adjacent to the injectors (8). The number of injectors (8) is variable. It depends on the length of the nozzle (1) and is determined so that the line formed by the powder on the substrate (2) is continuous and uniform.

Nozzle (1) further comprises at least one means (9) for injecting gas under pressure, called secondary gas, generally air or nitrogen. This injection means comprises a chamber for injection of gas under pressure, or several chambers connected to one another by a means that allow the gas situated in the body of the nozzle to pass to a chamber known as the upper chamber which is located on the upper part of the nozzle and then pass into the cavity (5) through opening (12).

Figure 2:
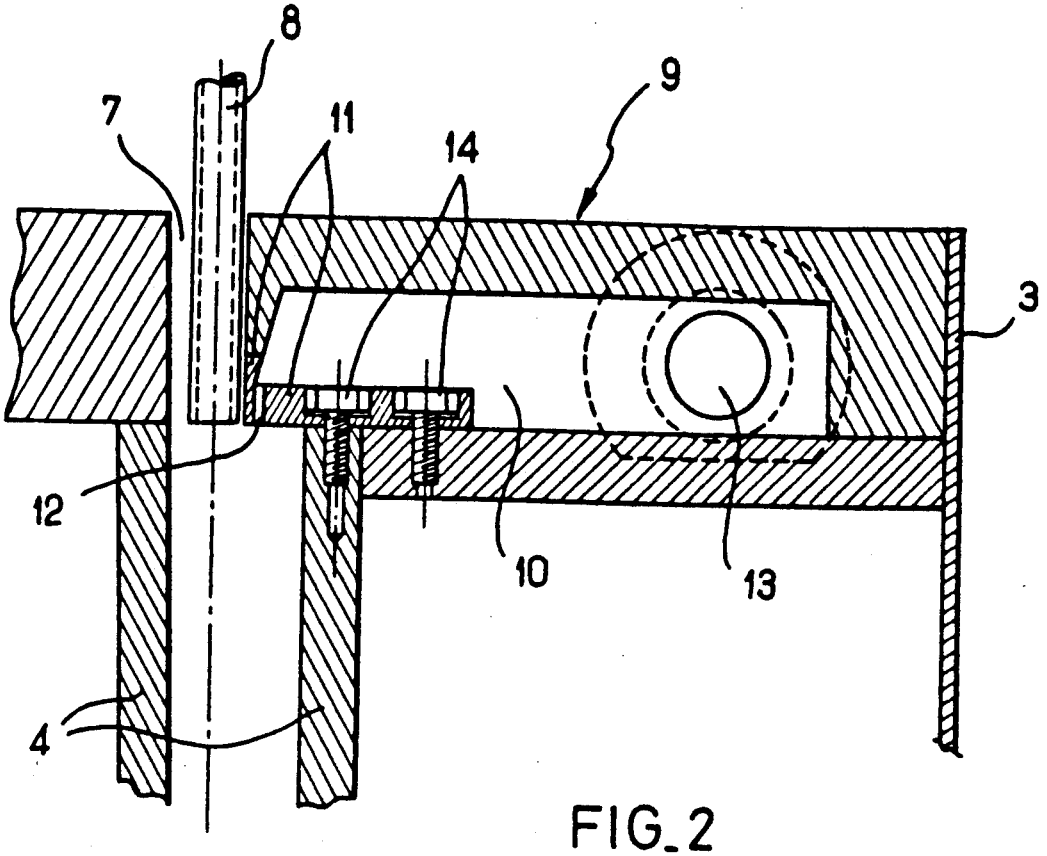
FIG. 2 discloses the means for injecting gas under pressure of the device according to the invention in the form of a sectional drawing.

According to one embodiment of the invention, an injection means (9) for injecting the secondary gas is represented in cross section in FIGS. 1 and 2 and comprises a chamber (10) for injection of said gas connected by a ramp (13) with holes to a source of gas. The secondary gas exits chamber (10) and enters cavity (5) via opening (12). The opening (12) is located near injectors (8) and tangentially to one of the inner walls (4) which delimit cavity (5).

Opening (12) may be of a plurality of jets piercing a plate, such as plate (11), which extends perpendicular to substrate (2). The axes of the jets are approximately parallel to the inner wall (4) of the cavity (5) which is adjacent to the jets. The jets (12) are preferably uniformly distributed perpendicular to the substrate (2). The jets have a diameter between 0.5 mm and 3 mm and preferably between 0.8 and 1.3 mm.

The interjet divergence or distance between the jets is between 1 mm and 15 mm and preferably between 5 mm and 10 mm. The lower end of the jets are located preferably at the level of the lower end of the injectors (8). Advantageously, means (9) for injecting gas under pressure is placed on only one side of the line of injectors (8).

Figure 3:
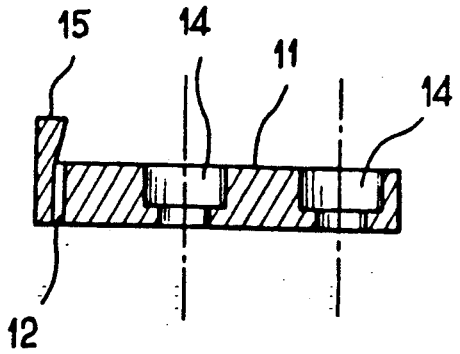
FIG. 3 discloses the plate with jets according to the invention; in the form of a sectional drawing.

As indicated in FIG. 3, plate (11) with jets can comprise an end edge (15) delimiting a guide wall in continuity with that of chamber (10), to guide the flow of the secondary gas under pressure toward the intakes of the jets. It is desirable for the plate (11) comprising the jets to be made of a metal which is not susceptible to corrosion, such as stainless steel. Plate (11), which represented in cross section in FIGS. 2 and 3, is fastened to body (3) of the nozzle (1) by any suitable fastening means (14).

In FIG. 1, there is shown a device which comprises an injection means for secondary gas, according to this invention, disposed on one side only of the line of the injectors. It constitutes only one advantageous form of embodiment of the invention. According to another form of embodiment of the invention, the device for the distribution of powder comprises two injection means for secondary gas, such as described earlier, disposed symmetrically about the line of the injectors (5).

Body (3) of nozzle (1) can be hollow and comprises various reinforcements or braces (16) to assure that it does not bend or deform under the operating conditions. Body (3) further comprises cooling elements (17) such as water circuits to prevent excessive heating of the nose of the nozzle (1) due to its proximity to the heated substrate (2). For coating float glass, the substrate is generally maintained at a high temperature on the order of 650°-700° C.

The nozzle (1) is positioned generally perpendicular to the plane of the substrate (2). The nozzle (1) can also be inclined in the direction of advance of the substrate (2). Outlet slot (6) can be positioned at a distance of approximately 15 to 120 mm, and preferably 30 to 90 mm, from the surface of the substrate (2).

Various powders are suitable to obtain a thin-layered coating of less than 0.4 microns, which exhibits particular optical qualities. The powders used to obtain these particular optical qualities are various powders with a base of different metals (tin, indium, titanium, chromium, iron, cobalt, etc.) and in particular, powders of dibutyltin oxide (DBTO), dibutyltin difluoride (DBTF), metal acetylacetonates and indium formate or mixtures of these powders are preferred. In order to obtain a sufficient coating of the substrate (2) in a short time, it is required that the vertical speed of fall of the powder be on the order of at least 10 to 15 m/sec at the outlet slot (6) of the nozzle (1). This is particularly important in the case of rapid displacement of the substrate, to obtain a good adherence of the powder on the substrate and to prevent the dispersal of the powder away from the substrate when it is released through the outlet slot (6) of the nozzle (1). On the other hand, to the extent that the reaction of the powder on the substrate requires a high temperature, it is also important not to excessively cool the substrate and therefore, the flow of the powder-carrying primary gas must not be too large.

To form a film having particular optical and/or electrical properties by depositing powders of organometallic compounds of DBTO (dibutylitin oxide) or DBTF (dibutyltin diflouride) with a grain size between 5 and 40 microns the impact speeds of the powder on the glass are generally equal to at least 10 m/sec and advantageously, between 25 and 60 m/sec. The device according to the invention described above makes possible the uniform depositing of powder suspended in gas to form such thin layers having the particularly desired optical and/or electrical properties.

During the use of the device according to the invention, the powder suspended in the so-called primary gas, for example of air or nitrogen, is introduced into cavity (5) delimited by the two inner walls (4) of the nozzle, by injectors (8). The cavity (5) in the shape of a blade is uniformly convergent and makes it possible to give the powder-gas mixture a constant acceleration.

A so-called secondary gas, under pressure, coming from injection chamber (10) is introduced into cavity (5) of the nozzle (1) by opening (12) consisting, for example, of jets pierced in plate (11). The secondary gas accelerates the displacement of the powder toward the substrate (2). The secondary gas further entrains ambient air arriving through the space existing between the injectors (8).

The secondary gas and the induced ambient air create turbulences in the powder suspension that homogenize the powder-gas mixture. By this system, a simultaneous homogenization and acceleration of the suspension of powder is obtained. The secondary gas is injected at a speed much greater than that of the powder at the outlet of injectors (8) in order to accelerate the powder-gas mixture and to facilitate the uniform distribution of the injected and induced gas flow over the entire length of the nozzle (1).

The presence of the opening according to the invention contributes certain advantages in relation to prior devices. In fact, as a consequence of the use of the opening according to this invention, for a given flow rate of secondary gas under pressure, the velocity of the gas, at the instant of its injection into the cavity, is higher. The volume of ambient air induced by the secondary gas under pressure is greater. It has been possible to observe, for example, that the volume of induced ambient air may correspond to the volume of secondary gas issuing from the opening, which makes possible improved homogenization of the powder-gas mixture.

It has been possible to observe, in addition, a more uniform distribution of the powder-gas suspension in the cavity (5) throughout the length of the nozzle: the width of the line of the powder deposited on the substrate corresponding to an injector is greater than when the prior devices are used. This results in the reduction of powder injectors required to coat a substrate of certain length. The prior devices required that the powder injectors used were spaced about 50 mm apart, the width of the line of powder on the substrate being about 50 mm. With a device according to the invention, used under the same condition, particularly the speed of the advancing substrate and gas flows, a width of the line of powder on the substrate of about 150 mm can be obtained. Thus, with the present invention, the distance between injectors can be greater and consequently their number can be reduced.

The opening (12), as it has been described earlier, which is constituted of a plurality of adjutages perforated through a plate, possesses in addition an advantage by comparison with the devices described in the prior art.

In fact, device such as that described in U.S. Pat. No. 4,562,095 mentioned earlier, comprise two continuous slits for supplying the pressurized gas into the central cavity. These slits have a width on the order of some tenths of a millimeter, which width is adjusted by sliding the plate which forms the cover of the cavity in a direction perpendicular to the longitudinal walls of the cavity.

The construction of these slits demands meticulous workmanship; in addition, it requires the presence of a holding system, such as reinforcements, within the thickness of the body of the nozzle to prevent deformation during operation when the temperature is high and the feed pressure of gas to the slits acts.

The adjustment of slits of this size for the purpose of achieving a constant width throughout their length is also especially difficult. In fact, the differences in width which could exist along the whole length of the slits would lead to undesired effects, notably a non-uniform distribution of the secondary gas flow and an inhomogeneity of the mixture of pulverulent product and gas, which would result on the substrate, in irridescence caused by the variations in thickness of the layer deposited.

In contrast to these devices, in the present invention the gas under pressure is injected into the cavity by adjutages, which may be perforated in a definitive manner in a plate fixed to the device. Thus the especially difficult adjustment of the width of the slit is unnecessary.

In addition, the plate comprising holes may be constructed by simple perforation.

The invention has been described in particular by referring to a device comprising an injection means for secondary gas situated on one side only of the line of the injectors and comprising a chamber supplied with pressurized gas and leading into the cavity (5) through an opening (12), constituted of a plurality of adjutages perforated in a plate (11) fixed to the body (3) of the nozzle (1).

According to another embodiment of the invention, the means for injecting secondary gas is situated on a single side of the line of injectors and comprises a chamber, whereby the secondary gas exits the chamber and enters the cavity (5) through an opening (12). Opening (12) is comprised of at least one slot placed over the entire length of nozzle (1) so the secondary gas is injected into cavity (5) approximately parallel to the inner wall adjacent to opening (12). The width of opening (12) can advantageously be between 0.2 mm and 2 mm. The slot can be made in a plate, similar to plate (11), and is fastened to the nozzle as represented in FIGS. 1, 2, and 3.

Figure 4:
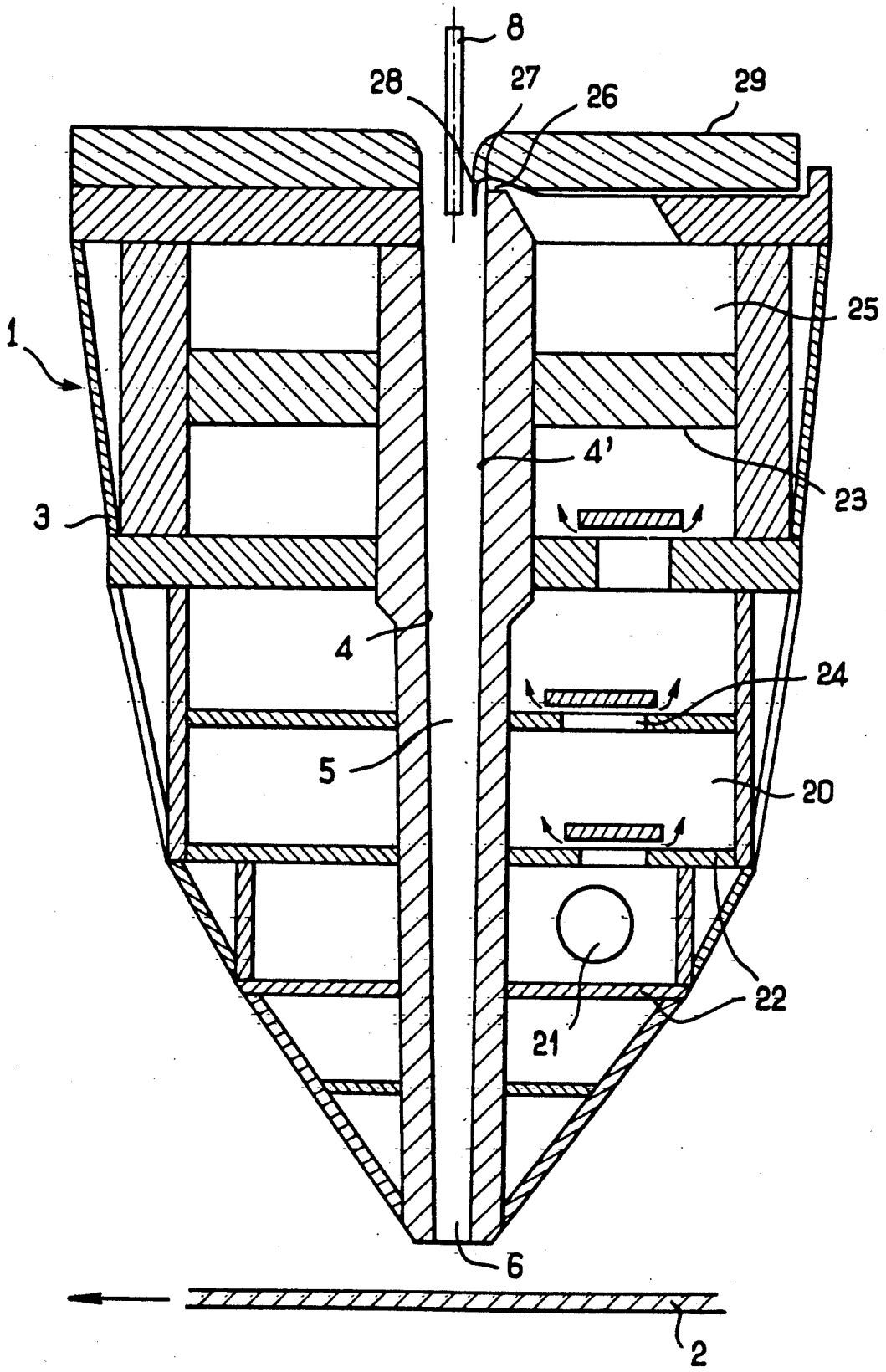
FIG. 4 discloses a second embodiment of the invention in the form of a sectional drawing.

According to another embodiment of the invention, the means for injecting secondary gas on a single side of the line of injectors (81), is of the type described in U.S. Pat. No. 4,562,095. As illustrated in FIG. 4, the means for the injection of secondary gas is comprised of a series of chambers (20) situated in the body of the nozzle (1) which are connected by a ramp (21) to a source of gas, generally air. The chambers (20) are connected to one another by a partition forming a brace (22). The brace (22) provides a passage means for the gas and comprises a porous material of the "Poral" type (23) or else a structural opening (24). Chamber (25) situated in the upper part of the nozzle injects secondary gas into cavity (5) through a slot (26) placed crosswise to substrate (2). Slot (26) is positioned to inject the secondary gas into cavity (5) approximately parallel to inner wall (4') of cavity (5) that is adjacent to slot (26). Slot (26) is limited by two lips (27) and (28); so-called lower lip (27) consists of the rounded upper edge of inner wall (41) of cavity (5) and so-called upper lip (28) is formed by the end of a plate (29) forming a cover for upper chamber (25). The interior surface of upper lip (28) has a configuration complementary to lower lip (27) so as to direct the secondary gas parallel to inner wall (41) of cavity (5). In particular, the end of upper lip (28) is located in cavity (5) at a distance of 10 mm to 20 mm from the upper edge of inner wall (4') comprising lower lip (27). The slot (26) limited by inner wall (4') of cavity (5) and the end of lip (28) has a width between 0.2 mm and 2 mm, advantageously it is 0.3 mm. In FIG. 4, the end of upper lip (28) has been represented with a dimension not in relation with that of the nozzle for the sole purpose of comprehension.

Although not shown in FIG. 4, it can be particularly appropriate to provide tie rods in the body of the nozzle. The tie rods act on wall (4') of the cavity to precisely adjust the width of the slot and to prevent deformations during operation.

EXAMPLE

According to a particular embodiment, a float glass sheet 4 mm thick advancing at a speed of 12.50 m/min is treated.

The powder used consists of dibutyltin difluoride with a grain size of less than 20 microns. The flow of powder is 5.6 kg per hour and per linear meter of length of nozzle.

The nozzle (1), as shown in FIG. 1, has an outlet slot (6) with a width of 4 mm. The distance between outlet slot (6) and the surface of the glass is 90 mm.

There are twenty four powder injectors (8) spaced about 140 mm apart.

Jets (12) have a diameter of 0.8 mm and the interjet distance is 1.5 mm.

The primary gas in which the powder is suspended is air. The flow is 100 $Nm^3$ per hour per linear meter of nozzle length ($Nm^3$=normalized $m^3$, i.e., brought back to normal pressure and temperature conditions).

The secondary gas under pressure (0.6 bars) is air whose flow is 160 $Nm^3$ per hour per linear meter of nozzle length.

The flow of induced ambient air is 160 $Nm^3$ per hour and per linear meter of nozzle length.

The line formed by the powder on the substrate at the outlet of the nozzle and corresponding to each injector is approximately 150 mm.

A layer of tin oxide doped with fluorine is obtained with a thickness between 1635 and 1650 Angstroms, that is with thickness deviations of 15 Angstroms.

Characteristics of the layer:

Coefficient of emissivity at 393° K.=0.3 light transmission: 83% color: bluish in reflection

In the preceding example, a nozzle was used comprising an opening (12), consisting of jets as defined above, situated on a single side of the line of injectors.

A layer of suitable properties can also be obtained by using a nozzle that, on a single side of the line of injectors, comprises any opening that makes it possible to inject the secondary gas into cavity (5) parallel to the wall of the cavity, according to the invention.

What is claimed is:

1. A device for distribution of a pulverulent solid suspended in a gas on an advancing substrate comprising:

a nozzle having a cavity extending the length of the nozzle and defined by two substantially planar converging side walls being substantially planar along their length, said walls forming an outlet slot on the lower part of said nozzle and an orifice at the opposite end of the cavity from the outlet slot;

means for injecting a mixture of pulverulent solid suspended in a gas into the cavity, said injecting means positioned in the orifice in the median plane of the cavity;

means for drawing gas into the cavity located adjacent to the pulverulent solid-gas mixture injecting means, and means for injecting a secondary gas under pressure into said cavity, said secondary gas injecting means comprising a chamber which is fed with said gas, whereby said gas enters the cavity through an opening substantially parallel to the inner wall of the cavity which is adjacent said opening, said opening comprising a multiplicity of jets with axes substantially parallel to the wall of the cavity that is adjacent to said jets, said jets being pierced in a plate closing said chamber and extending crosswise to the substrate.

2. Device according to claim 1 wherein said pulverulent solid-gas mixture injecting means comprises a plurality of injectors and wherein the means for injection of secondary gas is placed on only one side of said plurality of injectors.

3. Device according to claim 1 wherein said pulverulent solid-gas mixture injecting means comprises a plurality of injectors and two secondary gas injecting means positioned symmetrically in relation to the plurality of injectors.

4. Device according to claim 1 wherein the jets have a diameter between 0.5 and 3 mm.

5. Device according to claim 1 wherein the distance between adjacent jets is between 1 and 15 mm.

6. A device for distribution of a pulverulent solid suspended in a gas on an advancing substrate comprising:

a nozzle having a cavity extending the length of the nozzle and defined by two substantially planar converging side walls being substantially planar along their length, said walls forming an outlet slot in the lower part of said nozzle and an orifice at the opposite end of the cavity from the outlet slot;

means for injecting a mixture of pulverulent solid suspended in a gas into the cavity, said injecting means positioned in the orifice in the median plane of the cavity;

means for drawing gas into the cavity located adjacent to the pulverulent solid-gas mixture injecting means, and means located only on one side of said pulverulent solid injecting means for injecting a secondary gas under pressure into said cavity, said secondary gas injecting means comprising a chamber which is fed with said gas, whereby said gas enters the cavity through an opening substantially parallel to the inner wall of the cavity which is adjacent said opening, wherein the opening consists of a slot placed over the entire length of the device.

7. Device according to claim 6 wherein the slot is part of a plate that closes said chamber and extends the entire length of the device.

8. Device according to claim 6 wherein the slot is limited by a lower lip comprising a rounded upper edge upon the inner wall of said cavity and by an upper lip comprising the end of a plate that forms cover for said chamber injecting secondary gas, the interior surface of said upper lip having a configuration complementary to the lower lip.

9. Device according to claim 8 wherein the end of the upper lip is positioned in said cavity at a distance between 10 and 20 mm from the upper edge of the inner wall that forms the lower lip.

10. Device according to claim 9 wherein the slot limited by the end of upper lip and by said inner wall of cavity has a width between 0.2 and 2 mm.

11. Device according to claim 3 wherein said opening is placed near said pulverulent solid injecting means and tangentially to one of inner walls which delimit the cavity.

12. Device according to claim 1 wherein the inner walls delimiting the blade-shaped cavity are plane and form an angle of 0° to 3° with the median plane.

13. Device according to claim 12 wherein the inner walls delimit a blade-shaped cavity that is uniformly convergent toward the surface of the substrate.

14. Device according to claim 13 wherein the distance between the inner walls, at the level of the outlet slot is 3 to 4 times less than the distance between the inner walls at the level of the injection of the pulverulent product.

15. Device according to claim 14 wherein the distance between the inner walls at the level of the outlet slot is no greater than 10 mm.

16. Device according to claim 1 wherein the intakes of gas under pressure and of ambient air are located at the level of the outlet of the injectors of the pulverulent solid.

17. Device according to claim 1 wherein the injectors are positioned perpendicular to the axis of outlet slot.

18. Device according to claim 1 wherein the injectors are inclined in a direction other than perpendicular to the axis of outlet slot.

19. Device according to claim 1 wherein the device is placed perpendicular to the substrate.

20. Device according to claim 1 wherein the device is inclined in a direction other than perpendicular to the substrate.

21. Device according to claim 6 wherein said pulverulent solid-gas mixture injecting means comprises a plurality of injectors.

22. Device according to claim 21 wherein said opening is placed near said pulverulent solid injecting means and tangentially to one of said inner walls which delimit the cavity.

23. Device according to claim 6 wherein the inner walls delimiting the blade-shaped cavity are plane and form an angle of 0° to 3° with the median plane.

24. Device according to claim 23 wherein the inner walls delimit a blade-shaped cavity that is uniformly convergent toward the surface of the substrate.

25. Device according to claim 24 wherein the distance between the inner walls, at the level of the outlet slot is 3 to 4 times less than the distance between the inner walls at the level of the injection of the pulverulent product.

26. Device according to claim 25 wherein the distance between the inner walls at the level of the outlet slot is no greater than 10 mm.

27. Device according to claim 6 wherein the intakes of gas under pressure and of ambient air are located at the level of the outlet of the injectors of the pulverulent solid.

28. Device according to claim 6 wherein the injectors are positioned perpendicular to the axis of the outlet slot.

29. Device according to claim 6 wherein the injectors are inclined in a direction other than perpendicular to the axis of the outlet slot.

30. Device according to claim 6 wherein the device is placed perpendicular to the substrate.

31. Device according to claim 6 wherein the device is inclined in a direction other than perpendicular to the substrate.

32. A device for distribution of pulverulent solid suspended in a gas on an advancing substrate comprising:

a nozzle having a cavity extending the length of the nozzle and defined by two substantially planar converging side walls being substantially planar along their length, said walls forming an outlet slot on the lower part of said nozzle and an orifice at the opposite end of the cavity from the outlet slot, means for injecting a mixture of pulverulent solid suspended in a gas into the cavity, said injecting means positioned in the orifice in the median plane of the cavity, means for drawing gas into the cavity located adjacent tot he pulverulent solid-gas mixture injecting means, and means for injecting a secondary gas under pressure into said cavity said secondary gas injecting means comprising a chamber which is fed with said gas, whereby said gas enters the cavity through an opening comprising a slot extending over substantially the entire length of the device, wherein the slot is limited by a lower lip comprising a rounded upper edge upon the inner wall of said cavity and by an upper lip comprising the end of a plate that forms a cover for said chamber injecting said secondary gas, the interior surface of said upper lip having a configuration complementary to the lower lip, and whereby said gas enters the cavity substantially parallel to the inner wall of the cavity which is adjacent said opening.

33. Device according to claim 32 wherein the end of the upper lip is positioned in said cavity at a distance between 10 and 20 mm from the upper edge of the inner wall that forms the lower lip.

34. Device according to claim 33 wherein the slot has a width of between about 0.2 and 2 mm.

35. Device according to claim 32 wherein said secondary gas injecting means is located only on one side of said injecting means.

36. Device according to claim 32 wherein said pulverulent solid-gas mixture injecting means comprises a plurality of injectors.

37. Device according to claim 36 wherein said opening is placed near said pulverulent solid injecting means and tangentially to one of said inner walls which delimit the cavity.

38. Device according to claim 32 wherein the inner walls delimiting the blade-shaped cavity are plane and form an angle of 1° to 3° with the median plane.

39. Device according to claim 35 wherein the inner walls delimit a blade-shaped cavity that is uniformly convergent toward the surface of the substrate.

40. Device according to claim 39, wherein the distance between the inner walls, at the level of the outlet slot is 3 to 4 times less than the distance between the inner walls at the level of the injection of the pulverulent product.

41. Device according to claim 40 wherein the distance between the inner walls at the level of the outlet slot is no greater than 10 mm.

42. Device according to claim 32 wherein the intakes of gas under pressure and of ambient air are located at the level of the outlet of the injectors of the pulverulent solid.

43. Device according to claim 32 wherein the injectors are positioned perpendicular to the axis of the outlet slot.

44. Device according to claim 32 wherein the injectors are inclined in a direction other than perpendicular to the axis of the outlet slot.

45. Device according to claim 32 wherein the device is placed perpendicular to the substrate.

46. Device according to claim 32 wherein the device is inclined in a direction other than perpendicular to the substrate.

* * * * *